United States Patent [19]

Iizuka

[11] 4,184,470

[45] Jan. 22, 1980

[54] EGR CONTROL SYSTEM OF MULTI-CYLINDER ENGINES

[75] Inventor: Haruhiko Iizuka, Yokosuka, Japan

[73] Assignee: Nissan Motor Company, Limited, Yokohama, Japan

[21] Appl. No.: 896,226

[22] Filed: Apr. 13, 1978

[30] Foreign Application Priority Data

Apr. 22, 1977 [JP] Japan ..... 52-51797[U]

[51] Int. Cl.[2] ..... F02M 25/06; F02D 17/02; F02B 75/10

[52] U.S. Cl. ..... 123/198 F; 123/119 A

[58] Field of Search ..... 123/119 A, 198 F

[56] References Cited

U.S. PATENT DOCUMENTS

| | | | |
|---|---|---|---|
| 3,941,113 | 3/1976 | Baguelin | 123/119 A X |
| 4,106,471 | 8/1978 | Nakajima et al. | 123/198 F |
| 4,143,635 | 3/1979 | Iizuka et al. | 123/119 A X |

*Primary Examiner*—Wendell E. Burns

[57] ABSTRACT

A multi-cylinder internal combustion engine is equipped with an EGR control system in which the amount of the exhaust gases recirculated back to the cylinders of the engine is controlled in accordance with the intake vacuum in an intake passageway. The engine is constructed and arranged to control the number of cylinders operated in accordance with engine operating conditions. The EGR control system is provided with a device which can maintain a suitable exhaust gas recirculation even when a certain number of cylinders are not operated.

17 Claims, 4 Drawing Figures

EGR CONTROL SYSTEM OF MULTI-CYLINDER ENGINES

The present invention relates to an improvement in an exhaust gas recirculation (EGR) control system of a multi-cylinder internal combustion engine of the type wherein the number of cylinders operated is controlled to change in accordance with engine operating conditions.

A pincipal object of the present invention is to provide an improved internal combustion engine, by which fuel consumed in the engine is considerably saved, maintaining suitable emission control throughout all engine operating conditions.

Another object of the present invention is to provide an improved EGR control system of a multi-cylinder internal combustion engine of the type wherein the number of the cylinders operated is controlled to change in accordance with engine operating conditions, by which the formation of nitrogen oxides (NOx) is suppressed to a desired level throughout all engine operating conditions.

A further object of the present invention is to provide an improved EGR control system of a multi-cylinder internal combustion engine of the type wherein combustion in a particular group of cylinders is controlled not to take place under a certain engine operating condition, by which the amount of exhaust gases recirculated back to the cylinder is maintained at or above a desirable level even after the combustion in the group of cylinders is stopped.

A still further object of the present invention is to provide an improved EGR control system of a multi-cylinder internal combustion engine of the type wherein combustion in a particular group of cylinder is controlled not to take place under a certain engine operating condition in which an EGR control vacuum in the intake passageway is considerably lowered when the combustion in the particular group of cylinders does not take place, by which the amount of the exhaust gases recirculated back to the cylinders is maintained at or above a desired level even when the EGR control vacuum is considerably lowered.

Other objects, features and advantages of the present invention will be more apparent from the following description taken in conjunction with the accompanying drawings in which.

Figure 1:
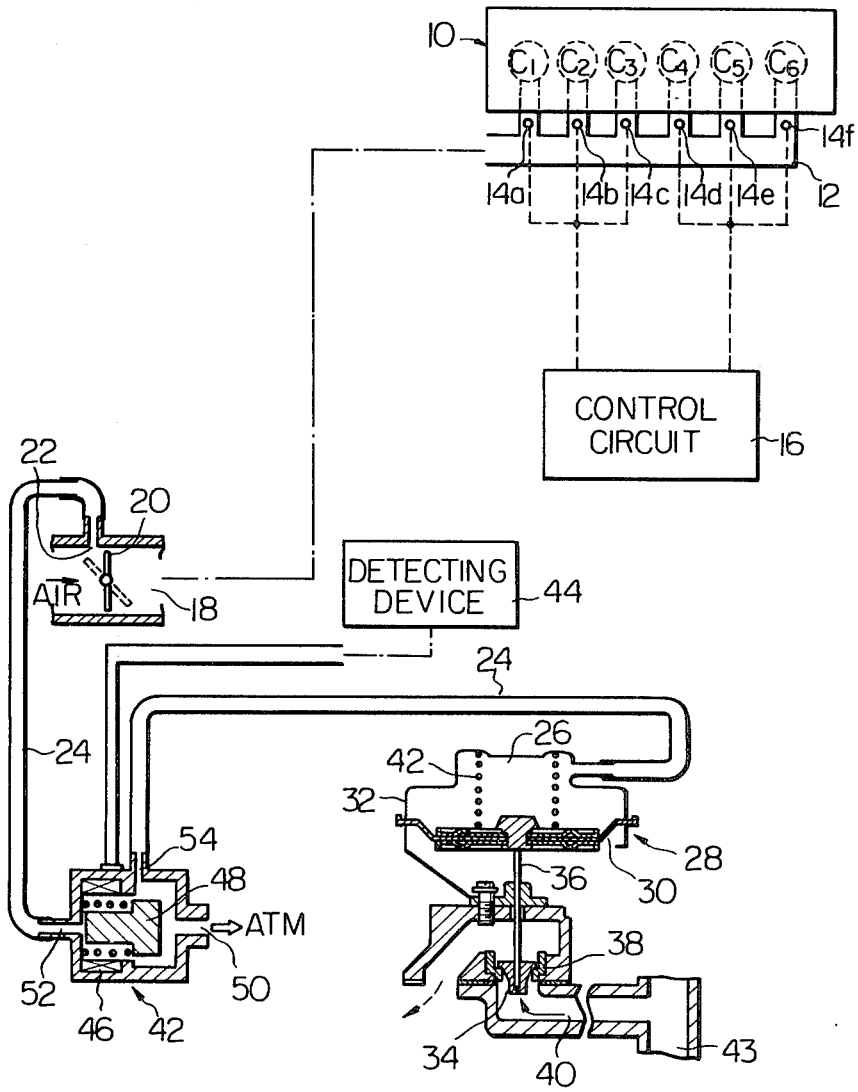
FIG. 1 is a schematic cross-sectional view of an already proposed EGR control system in combination with a multi-cylinder internal combustion engine of the type wherein the number of cylinders operated is changeable.

Referring now to FIG. 1 of the drawings, there is shown an example of already proposed exhaust gas recirculation (EGR) control systems in combination with an engine having an engine proper 10 which is equipped with an intake manifold 12 which has six branch runners (no numerals). The six branch runners are communicable with the corresponding cylinders $C_1$ to $C_6$, respectively. The reference numerals 14*a* to 14*f* represent fuel injectors which are disposed in the corresponding manifold branch runners, respectively. Each fuel injector is constructed and arranged to inject metered fuel into the corresponding branch runner. It is to be noted that this engine is of the type wherein operations of a particular group of cylinders is controlled in accordance with engine operating conditions, in other words, the particular group of cylinders is not supplied with fuel to be kept inoperative under a certain engine operating condition in which combustions in all engine cylinders are not necessary for the purpose of saving fuel. In this example, all cylinder or six-cylinder operation is changed into partial cylinder or three-cylinder operation under the certain engine operation condition since the three fuel injectors 14*a*, 14*b* and 14*c* are arranged to stop fuel injection under the certain engine operating condition by means of a control circuit 16. Such an engine has, for example, been disclosed in the allowed application of Haruhiko Iizuka, U.S. patent application Ser. No. 747,476, filed on Dec. 6, 1976 and entitled "Apparatus and Method for Controlling Ignition of Multi-cylinder Internal Combustion Engines".

The intake manifold 12 connects to an intake passageway 18 which provides communication between the atmosphere and the cylinders. A throttle valve 20 is rotatably disposed in the intake passageway 18. A port 22 is formed through the wall of the intake passageway 18 and opens adjacent the throttle valve 20. The port 22 communicates via a vacuum passage 24 with a vacuum chamber 26 of an EGR control valve 28 which forms part of the EGR control system (no numeral). The EGR control valve 28 consists of a flexible diaphragm member 30 which defines the vacuum chamber 26 in cooperation with the wall of the upper portion of a casing 32. A valve head 34 is securely connected through a valve stem 36 to the diaphragm member 30. The valve head 34 is arranged to be seatable on a valve seat 38 formed at the inner surface of EGR passageway 40. A spring 41 is disposed in the vacuum chamber 26 to urge the diaphragm member downward in the drawing or in a direction to cause the valve head 34 to seat on the valve seat 38.

The EGR passageway 40 connects between the intake passageway 18 and an exhaust gas passageway 43 which provides communication between the interior of each cylinder and the atmosphere to discharge exhaust gases into the atmosphere. Accordingly, a part of the exhaust gases is recirculated through the EGR passageway back to the cylinders.

A three-way solenoid valve 42 is disposed in the vacuum passage 24 and electrically connected to a detecting device 44. The detecting device 44 functions to detect engine operating conditions, i.e. engine load, engine speed, engine coolant temperature and throttle position, and to electrically control operation of the three-way solenoid valve 42 in accordance with the engine operating conditions. In this example, detecting device 44 is constructed and arranged to normally deenergize a solenoid coil 46 of the solenoid valve 42 so that a movable valve member 48 is put into a position to close a port 50 which communicates with the atmosphere by means of a spring (no numeral) for urging the valve member in a direction of the port 50. Then, the ports 52 and 54 communicate to supply intake vacuum in the intake passageway 18 through the vacuum passage 24 into the vacuum chamber 26 of the EGR control valve 28. As a result, the valve head 34 is moved in accordance with the magnitude of the intake vacuum in the intake passageway 18 and therefore the amount of the exhaust gases recirculated back to the cylinders is controlled in accordance with the intake vacuum in the intake passageway 18.

On the contrary, under particular engine operating conditions where stop of exhaust gas recirculation is desirable, such as during engine idling and low load engine operation, the detecting device 44 energizes the solenoid coil 46 of the solenoid valve 42 so that the valve member 48 is moved into a position shown in FIG. 1 where the port 50 is opened and the port 52 is closed to bleed atmospheric air into the vacuum passage 24. Then, the vacuum chamber 26 of the EGR control valve 28 is supplied with atmospheric air, causing the valve head 34 to seat on the valve seat 38. Therefore, the exhaust recirculation back to the cylinders can be stopped.

However, the thus arranged engine has encountered the problems which will be discussed hereinafter. It is to be noted that it is usual to continue the operation of intake and exhaust valves of the cylinder in which no combustion occurs due to stopping fuel supply. On this ground, when the six-cylinder operation is changed into the three-cylinder operation, it is necessary to increase the opening degree of the throttle valve 18 to compensate lowering in engine power output or to increase the volumetric efficiency of the engine, for the purpose of preventing a shock or motion surge caused by an abrupt change in engine power output. Then, the intake vacuum at the port 22 adjacent the throttle valve 20 is abruptly lowered to a great extent, decreasing the intake vacuum supplied to the vacuum chamber 26 of the EGR control valve to change the intake vacuum to atmospheric pressure. As a result, the valve head 34 is moved downward to decrease the opening degree of the opening area defined between the valve head 34 and the valve seat 38. Furthermore, since the intake vacuum in the intake passageway 18 is decreased to about atmospheric vpressure, the pressure differential between the upstream and downstream sides of the valve head 34 is decreased. These result in an abrupt decrease in the amount of the exhaust gases recirculated back to the cylinders through the EGR passageway 40 at a movement the six-cylinder operation is changed into the three-cylinder operation. It seems that the latter greatly contributes to decrease the amount of recirculated exhaust gases as compared with the former.

In view of the above discussion, the present invention contemplates to solve the problems encountered in the already proposed EGR control system of the multi-cylinder engine, in order to maintain a suitable exhaust gas recirculation even after all-cylinder operation is changed into partial-cylinder operation.

Figure 2:
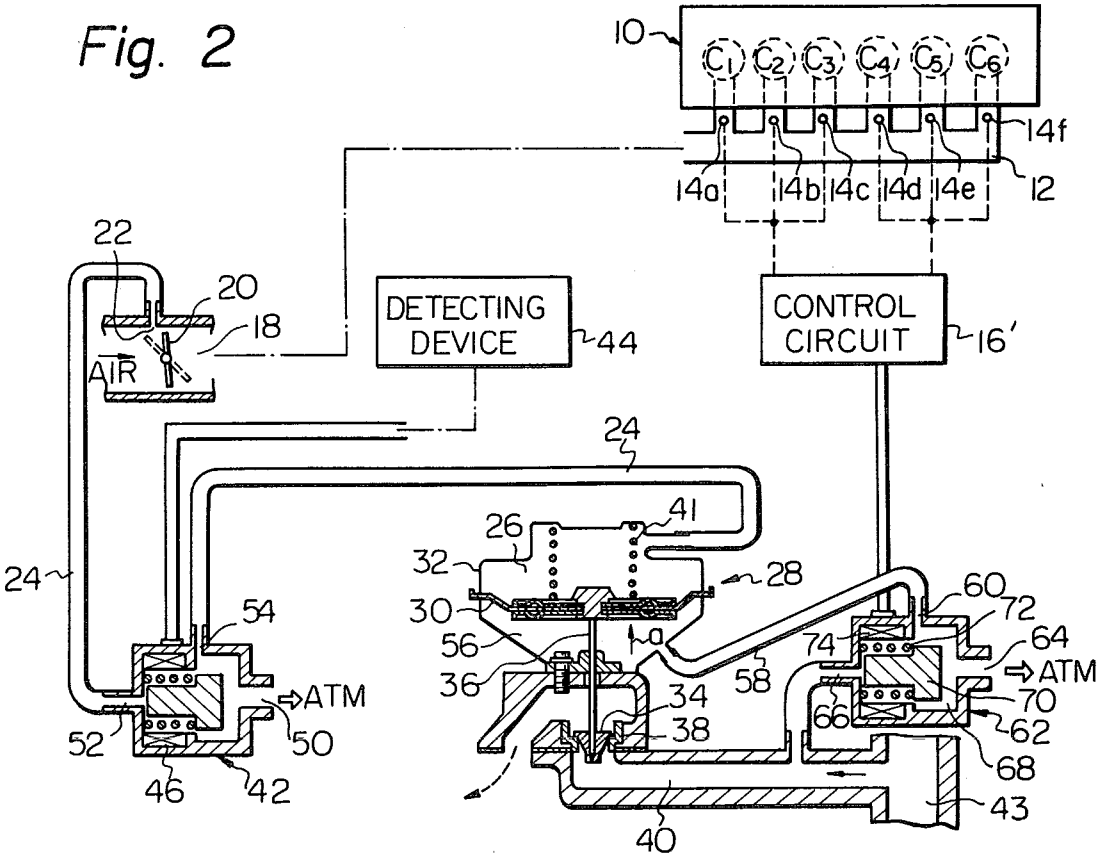
FIG. 2 is a schematic cross-sectional view of a preferred embodiment of an EGR control system according to the present invention in combination with a multi-cylinder internal combustion engine of the type wherein the number of cylinders operated is changeable in accordance with engine operating conditions.

Referring now to FIG. 2 of the drawings, a preferred embodiment of an exhaust gas recirculation (EGR) control system according to the present invention is shown in combination with a multi-cylinder internal combustion engine, in which the same reference numerals as in FIG. 1 are assigned to corresponding parts and elements for the purpose of simplicity of description.

As shown in FIG. 2, the EGR control valve 28 is provided with another chamber or a lower chamber 56 which is defined by the diaphragm member 30 and the inside wall surface of the lower part of the casing 32. The chamber 56 is located at the opposite side of the chamber 26 of the diaphragm member 30. The chamber 56 communicates through a passage 58 with a first port 60 of a three-way solenoid valve 62. The three-way solenoid valve 62 is formed with a second port 64 communicating with the atmosphere and a third port 66 communicating with the EGR passageway 40. All the ports 60, 64 and 66 open to a chamber 68 defined interior of the casing of the three-way solenoid valve 62. A valve member 70 is disposed movably in the chamber 68 and takes a first position to close the second port 64 and open the third port 66 by the bias of a spring 72 when the solenoid coil 74 of the solenoid valve 62 is de-energized, and a second position to open the second port 64 and close the third port 68 overcoming the bias of the spring 72 when the solenoid coil 74 is energized.

The solenoid coil 74 of the solenoid valve 62 is electrically connected to a control circuit 16'. The control circuit 16' is constructed and arranged to generate an electric energizing signal to energize the solenoid coil 74 during all-cylinder operation or six-cylinder operation of the engine where fuel is supplied to six cylinders $C_1$ to $C_6$ by means of the fuel injectors 14*a* to 14*f*, whereas an electric de-energizing signal to de-energize the solenoid coil 74 during partial cylinder operation or three-cylinder operation where the fuel is supplied only to the three cylinders $C_4$, $C_5$ and $C_6$. Of course, the partial cylinder operation takes place when the engine is operated under the certain condition in which all cylinder operation is unnecessary for the purpose of saving fuel.

In operation of the arrangement of FIG. 2, during six-cylinder operation, the solenoid coil 74 of the three-way solenoid valve 62 is energized and consequently the valve member 70 takes the first position to supply atmospheric air to the lower chamber 56 of the EGR control valve 28. As a result, the diaphragm member 30 is moved in accordance with the magnitude of the intake vacuum sensed at the port 22 which is located just upstream of the edge of the throttle valve 20 at its fully closed position, the relative location of the port 22 being changed gradually downstream of the edge of the throttle valve 20. Therefore, the amount of the exhaust gases recirculated back to the cylinders is controlled in accordance with the intake vacuum in the intake passageway 18 is during six-cylinder operation.

On the contrary, when the six-cylinder operation is changed into the three-cylinder operation, the solenoid coil 74 of the three-way solenoid valve 62 is deenergized to open the port 66 to supply the exhaust gases in the EGR passageway 40 to the lower chamber 56 of the EGR control valve 28. As a result, the pressure of the exhaust gases acts on the lower surface of the diaphragm member 30 to push up or move the diaphragm member 30 in a direction of an arrow a. This causes the valve head 34 to move in the direction of arrow a and accordingly the opening area defined between the valve head 34 and the valve seat 38 is increased to increase the amount of the exhaust gases passing through the EGR passageway 40. Accordingly, although the opening degree of the throttle valve 20 is increased at the moment the six-cylinder operation is changed into the three-cylinder operation and the intake vacuum supplied to the vacuum chamber 26 of the EGR control valve 28 is abruptly considerably lowered, a relatively large amount of the recirculated exhaust gases can be maintained. In other words, even during the partial cylinder operation of the engine, an amount of the recirculated exhaust gases is maintained at or above a level during the all cylinder operation, regardless of change in the intake vacuum in the intake passageway 18.

While the port 66 of the three-way solenoid valve 62 has been shown and described to communicate with the EGR passageway 40 with reference to FIG. 2, the port 66 may communicate with an exhaust gas passageway downstream of an exhaust gas purifying device such as a catalytic converter, in case of the engine equipped with such an exhaust gas purifying device in the exhaust gas passageway which communicates the cylinders with the atmosphere to discharge the exhaust gases into the atmosphere. With this arrangement, a small amount of the exhaust gases supplied to the lower chamber 56 of the EGR control valve 28 never contributes to air pollution, if the exhaust gases in the lower chamber 56 are discharged through the second port 64 of the three-way solenoid valve 62. However, since the amount of the exhaust gases supplied to the lower chamber 56 in case of FIG. 2 is very small, it will be understood that air pollution thereby may be negligible even if the gases in the lower chamber 56 are discharged directly into the atmosphere.

Now, the control circuit 16' of this case is similar to that of FIG. 1, but improved as compared with the control circuit 16 of FIG. 1. The control circuit 16' is arranged to cause six fuel injectors 14*a* to 14*f* to inject fuel in order to carry out six-cylinder operation under a first engine operating condition, whereas to prevent the three fuel injectors 14*a*, 14*b* and 14*c* from fuel injection in order to carry out three-cylinder operation under a second engine operating condition.

The engine operating conditions are determined by sensing engine speed (r.p.m) and pulse width (ms) of an electric signal for controlling the amount of fuel injected from each fuel injector. It is noted that fuel injection continues for the time duration corresponding to the pulse width. The pulse width is a value proportional to the amount of intake air during one revolution of the crank shaft (not shown) of the engine and accordingly is proportional to the engine torque generated.

Figure 3:
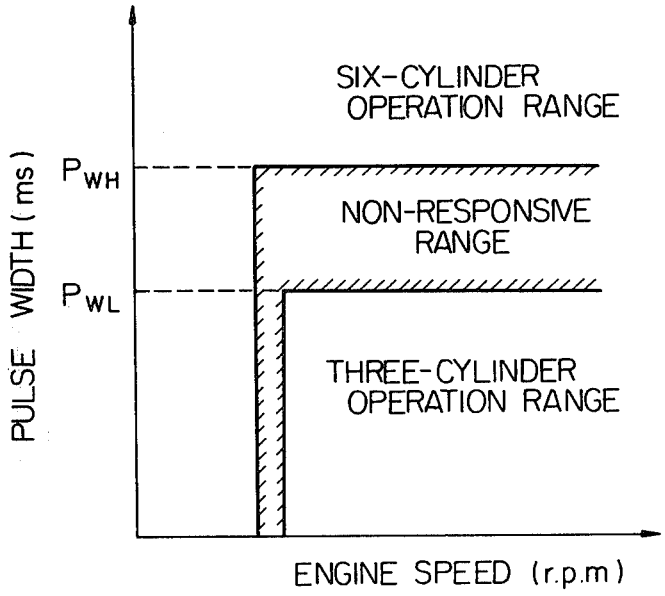
FIG. 3 is a diagram showing "non-responsive range" of the engine of FIG. 2.

In this case, by means of the control circuit 16', control of the number of cylinders operated is scheduled as shown in FIG. 3 in which "six-cylinder operation range" corresponds to the first engine operating condition and "three-cylinder operation range" corresponds to the second engine operating condition. As seen from FIG. 3, as engine load increases, the partial cylinder or the three-cylinder operation is changed into the all cylinder or the six-cylinder operation. Additionally, six-cylinder operation is carried out during low engine speed operation, since stable engine operation cannot be obtained by the three-cylinder operation during the low engine speed operation.

A "non-responsive range" in FIG. 3 is a range in which the number of cylinders operated does not change, i.e., the number of cylinders operated is maintained at the same state before entering the "non-responsive range". In other words, if the engine operating condition is changed from the "three-cylinder operation range" to the "non-responsive range", the three-cylinder operation is maintained even at the "non-responsive range". In order to prevent unnecessary frequent change from the six-cylinder operation to the three-cylinder operation and vice versa and to achieve necessary change in the number of cylinders operated, the "non-reactive range" in pulse width [represented as $(P_{wh}-P_{wl}/P_{wh})\times 100(\%)$] preferably selected within the range of from 30 to 40% of a predetermined pulse width $P_{wh}$ at which "six-cylinder operation range" is changed into the "non-responsive range" or the six-cylinder operation starts, and $P_{wl}$ represents another predetermined pulse width at which the "three-cylinder operation range" is changed into the "non-reactive range".

While only the six-cylinder engine has been shown and described, it will be understood that the EGR control system according to the present invention and the control circuit 16' in FIG. 2 may be applicable for other types of engines, for example, four-cylinder engines and eight-cylinder engines.

Figure 4:
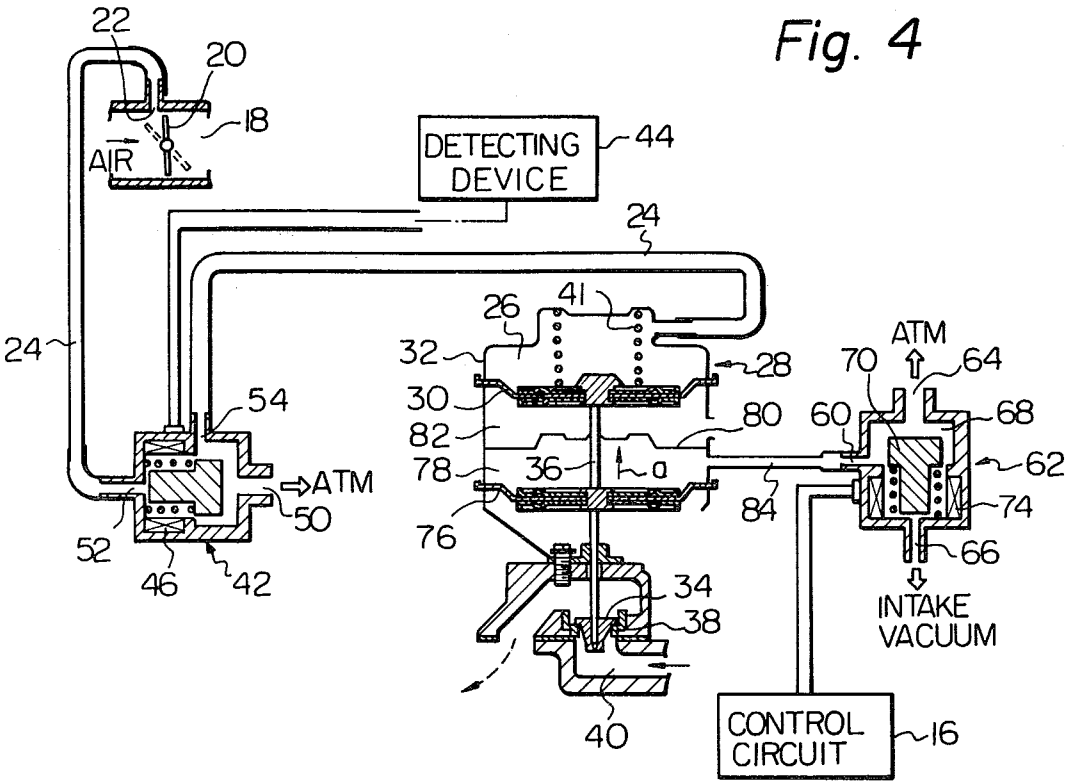
FIG. 4 is a schematic cross-sectional view of an EGR control system similar to that of FIG. 2, but showing another preferred embodiment in accordance with the present invention.

FIG. 4 shows another preferred embodiment of the EGR control system in accordance with the present invention, in which the same reference numerals as in FIG. 2 represent the corresponding parts and elements.

In this embodiment, the valve stem 36 is formed longer than that of FIG. 2. Another flexible diaphragm member 76 is secured to the valve stem 36 and defines a vacuum operating chamber 78 in cooperation with a separating wall 80 securely disposed between the diaphragm members 30 and 76. The separating wall 80 further defines an atmospheric chamber 82 in cooperation with the diaphragm member 30. The diaphragm 76 is, as seen, located parallelly with the diaphragm member 30 and spaced apart from the diaphragm member 30 and the valve head 34 is disposed in the EGR passageway. The vacuum operating chamber 78 communicates through a vacuum passage 84 with the port 60 of the three-way solenoid valve 62. It is to be noted that the three-way solenoid valve 62 is constructed and arranged similarly to that of FIG. 2 with the exception that the port 66 communicates with the intake passageway 18 to establish communication between the vacuum operating chamber 78 and the intake passageway 18 when the solenoid coil 74 of the solenoid valve 62 is de-energized.

With the thus arranged engine, during the six-cylinder operation, the solenoid coil 74 of the three-way solenoid valve 62 is energized to communicate the vacuum operating chamber 78 of the EGR control valve 28 with the atmosphere. The valve head 34 of the EGR control valve 28 is controlled to move only in response to the vacuum conducted to the vacuum chamber 26 of the EGR control valve 28. Therefore, the amount of the exhaust gases recirculated back to the cylinders is controlled only in accordance with the magnitude of the intake vacuum in the intake passageway 18.

When the six-cylinder operation of the engine is changed into the three-cylinder operation, the solenoid coil 74 of the solenoid valve 62 is de-energized to cause the vacuum operating chamber 78 to communicate with the intake passageway 18 through the port 66 of the three-way solenoid valve 62. Then, the vacuum operating chamber 78 is supplied with the intake vacuum in the intake passageway 18. As a result, the diaphragm member 76 is moved upward in the drawing or in the direction of the arrow a to cause the valve head 34 to move upward. This increases the opening area defined by the valve head 34 and the valve seat 38, and accordingly the amount of the exhaust gases passing through the EGR passageway is increased. Therefore, the amount of the exhaust gases recirculated back to the cylinders can be maintained suitably or increased regardless of change in the intake vacuum supplied to the vacuum chamber 26 of the EGR control valve 28.

While the principle of the present invention has been shown and described to be applied only to the EGR control system of the type wherein the exhaust gas recirculation is controlled in response to the change in the intake vacuum in the intake passageway 18 adjacent the throttle valve, it will be understood that the same principle may be applied to other EGR control systems, for example, of the type wherein the amount of recirculated exhaust gases is controlled in accordance with exhaust pressure in an EGR passageway, as disclosed in U.S. Pat. No. 3,834,366 issued on Sept. 10, 1974 to William L. Kingsbury, and of the type wherein the amount of recirculated exhaust gases is controlled in accordance with the cooperation of venturi vacuum and the pressure in an EGR passageway, as disclosed in the pending application of the same applicant as in the present application, U.S. Patent application Ser. No. 786,812, filed on Apr. 12, 1977 and entitled "An Exhaust Gas Recirculation Control System".

Although only the engine equipped with an electronically controlled fuel injection system as a fuel supply system has been shown and described to be used in combination with the EGR control system according to the present invention, it will be appreciated that the EGR control system according to the present invention may be used with engines equipped with other fuel supply systems such as ones equipped with a carburetor or carburetors.

What is claimed is:

1. A multi-cylinder internal combustion engine of the type wherein fuel supply to a predetermined group of cylinders is controlled to be stopped in accordance with engine operating conditions, said engine having an intake passageway and an exhaust gas passageway which are communicable with all cylinders of the engine, comprising:

an exhaust gas recirculation (EGR) passageway through which the exhaust gas passageway is communicable with the intake passageway to recirculate a part of exhaust gases through the intake passageway back to the cylinders;

an EGR control valve operatively disposed in said EGR passageway, the opening degree of said EGR control valve being controllable in response to vacuum in the intake passageway to control the amount of the exhaust gases recirculated to the cylinders;

sensing means for sensing a certain engine operating condition in which fuel supply to the predetermined group of cylinders is stopped, to produce a signal; and increasing means for increasing the opening degree of said EGR control valve in response to the signal from said sensing means in order to increase the amount of the exhaust gases recirculated back to the cylinders.

2. An engine as claimed in claim 1, in which said EGR control valve includes:

a first diaphragm member defining a first chamber which is communicable with the intake passageway, a valve head securely connected to said diaphragm member and seatable on a valve seat formed in said EGR passageway to control the opening area defined between said valve head and said valve seat.

3. An engine as claimed in claim 2, in which said increasing means includes urging means for urging said first diaphragm in a direction to increase the opening area defined between said valve head and valve seat by applying a physical force to a surface of said first diaphragm member which surface is opposite to its other surface defining the first chamber, upon receiving the signal from said sensing means.

4. An engine as claimed in claim 3, in which said physical force is the pressure of the exhaust gases.

5. An engine as claimed in claim 4, in which the exhaust gas pressure is from said EGR passageway.

6. An engine as claimed in claim 3, in which said physical force is the intake vacuum in the intake passageway.

7. An engine as claimed in claim 5, in which said urging means includes means for defining a second chamber in cooperation with said first diaphragm member, the second chamber being located opposite to the first chamber about said first diaphragm member, valve means capable of taking a first state wherein the second chamber communicates with said EGR passageway upon receiving the signal from said sensing means.

8. An engine as claimed in claim 7, in which said valve means is a three-way solenoid valve having a first port communicating with the second chamber, a second port communicating with the atmosphere, a third port communicating with said EGR passageway, and a movable valve member which is moved to establish communication between the first and second ports when the solenoid coil of said solenoid valve is energized upon receiving an electric energizing signal, but to establish communication between the first and third ports when the solenoid coil is de-energized upon receiving an electric de-energizing signal.

9. An engine as claimed in claim 7, in which said sensing means includes means for producing the electric de-energizing signal for the solenoid of said three-way solenoid valve under the certain engine operating condition, and an electric energizing signal for the solenoid under engine operating conditions other than the certain engine operating condition.

10. An engine as claimed in claim 4, in which said EGR control valve includes a spring disposed in the first chamber to urge said first diaphragm member in a direction to cause said valve head to seat on said valve seat.

11. An engine as claimed in claim 6, in which said urging means includes a second diaphragm member securely connected to said first diaphragm member to move integrally with the first diaphragm member and said valve head, said second diaphragm member being located parallelly with said first diaphragm member and defining a second chamber by a surface thereof which surface is opposite to said other surface of said first diaphragm member, and valve means capable of taking a first state wherein the second chamber communicates with the intake passageway upon receiving the signal from said sensing means.

12. An engine as claimed in claim 11, in which said valve means includes a three-way solenoid valve having a first port communicating with the second chamber, a second port communicating with the atmosphere, a third port communicating with the intake passageway, and a movable valve member which is moved to establish communication between the first port and the second port when the solenoid coil of said three-way solenoid valve is energized upon receiving an electric energizing signal, but to establish communication between the first port and the third port when the solenoid coil is de-energized upon receiving an electric de-energizing signal.

13. An engine as claimed in claim 12, in which said sensing means includes means for producing the electric de-energizing signal for the solenoid coil of said three-way solenoid valve under the certain engine operating condition, and the electric energizing signal under engine operating conditions other than the certain engine operating condition.

14. An engine as claimed in claim 6, in which said EGR control valve further includes a spring disposed in the first chamber to urge said first diaphragm member in a direction to cause said valve head to seat on said valve seat.

15. An engine as claimed in claim 14, said EGR control valve comprising a straight extending valve stem connecting between the first diaphragm member and said valve head, to which said second diaphragm member is secured parallelly with said first diaphragm member and spacedly apart from said first diaphragm member and said valve head.

16. An engine as claimed in claim 1, further comprising fuel injectors for supplying metered fuel into the cylinders, respectively, each fuel injector being arranged to inject fuel for a time duration corresponding to a pulse width of an electric signal for controlling the amount of fuel injected from the injector.

17. An engine as claimed in claim 16, further comprising means for controlling "non-responsive range" within the range from 30 to 40% in pulse width of a predetermined pulse width of said electric signal, at which predetermined pulse width operation of all the cylinders of the engine starts.

* * * * *